US005099093A

United States Patent [19]

Schels et al.

[11] Patent Number: 5,099,093

[45] Date of Patent: Mar. 24, 1992

[54] VACUUM SWITCHING CHAMBER

[75] Inventors: Karl W. Schels, Laaber; Manfred Niegl, Regensburg, both of Fed. Rep. of Germany

[73] Assignee: Sachsenwerk Aktiengesellschaft, Regensburg, Fed. Rep. of Germany

[21] Appl. No.: 654,884

[22] Filed: Feb. 1, 1991

[30] Foreign Application Priority Data

Feb. 1, 1990 [DE] Fed. Rep. of Germany ..... 4002933

[51] Int. Cl.[5] ..... H01H 9/30; H01H 33/14

[52] U.S. Cl. ..... 200/144 B

[58] Field of Search ..... 200/144 B

[56] References Cited

U.S. PATENT DOCUMENTS

| | | | |
|---|---|---|---|
| 4,629,839 | 12/1986 | Falkingham | 200/144 B |
| 4,667,070 | 5/1987 | Zückler | 200/144 B |
| 4,717,797 | 1/1988 | Hoene | 200/144 B |

FOREIGN PATENT DOCUMENTS

| | | |
|---|---|---|
| 162801 | 11/1985 | European Pat. Off. . |
| 381843 | 8/1990 | European Pat. Off. . |
| 2443141 | 5/1978 | Fed. Rep. of Germany . |
| 3227482 | 2/1983 | Fed. Rep. of Germany . |
| 3407088 | 8/1985 | Fed. Rep. of Germany . |
| 3406535 | 9/1985 | Fed. Rep. of Germany . |
| 3422949 | 12/1985 | Fed. Rep. of Germany . |
| 3245609 | 5/1987 | Fed. Rep. of Germany . |
| 3808248 | 7/1988 | Fed. Rep. of Germany . |
| 3724425 | 7/1989 | Fed. Rep. of Germany . |
| 2231723 | 11/1990 | United Kingdom . |

*Primary Examiner*—Harold Broome
*Attorney, Agent, or Firm*—Spencer & Frank

[57] ABSTRACT

A vacuum switch which includes two identical facing switch contacts equipped with a cup shaped coil body that is provided with annular contact elements covering the open end of the cup shaped coil body. In order to form turn conductors, the coil body is penetrated by a plurality of throughgoing slots which are inclined relative to the axis and are distributed symmetrically over the circumference of the coil body. A supporting ring is disposed in the cavity between the bottom of the coil body and the contact element which is formed of circular ring sectors. In order to realize high protection against arcbacks, four of the throughgoing slots are provided and are inclined at an angle between 60° and 75° relative to the axis and extend in the circumferential direction between the contact element and the cup bottom at most over a rotation angle between 60° and 90°. Moreover, each circular ring sector is provided with at least one cutin gap which is oriented radially from the inside to the outside, while the supporting ring is disposed in close proximity to the inner diameter of the cup wall.

9 Claims, 4 Drawing Sheets

VACUUM SWITCHING CHAMBER

CROSS REFERENCE TO RELATED APPLICATIONS

The present application claims the rights of priority with respect to application Serial No. P 40 02 933.6 filed Feb. 1st, 1990 in the Federal Republic of Germany, the subject matter of which is incorporated herein by reference.

BACKGROUND OF THE INVENTION

The present invention relates to a vacuum switching chamber of the type disclosed in German Offenlegungsscrift [laid-open patent application] No. 3,227,482. Such a vacuum switching chamber includes two mutually identically configured switch contacts which are each disposed at an end face of coaxial contact pins and face one another. The switch contacts are each composed of a cup-shaped coil body having attached at its open end face a contact element shaped overall like a circular disc or circular ring. In the closed state of the switch contacts, the contact elements lie flush against one another. In order to form turn conductors and generate an axial magnetic field, the cup walls of the coil body are penetrated by several slots which pass through the cup wall and also into the cup bottom. The slots are arranged at a considerable angle relative to the axis of the contact pins and are distributed symmetrically over the circumference of the coil body. Within the cavity of the coil body, between its bottom and the contact element, there is disposed a concentric supporting ring which is arranged in the region of the contact element near the axis. The contact element is provided with radial slots which are continued in associated slots of the cup wall.

SUMMARY OF THE INVENTION

It is an object of the present invention to improve a vacuum switching chamber of the above-mentioned type so that there is a high reliability against arcbacks when a high short-circuit current is turned off at a high alternating current short-circuit value.

The above and other objects are accomplished in the context of the above described vacuum switching chamber wherein, according to the invention four slots are provided in the cup wall, each one of the slots having a central section formed by a planar cut through the cup wall, with the cuts being inclined at an angle between 60° and 75° relative to the axis of the contact pins, and the central section of the slots covering an angle of rotation between 60° and 90° in the circumferential direction of the cup wall; and the contact element is comprised of ring sectors extending in the circumferential direction over a section of at least one of the turn conductors, each circular ring sector including at least one cut-in gap which is directed radially from the inside of the circular ring sector toward the outside of the circular ring sector and extending to the region of the inner diameter of the cup wall, wherein each turn conductor of the cup wall has a radial wall thickness which is approximately 10% of the outer diameter of the coil body.

In one embodiment of the vacuum switching chamber according to the invention, each circular ring sector of the contact element has an outer radial portion which extends 90°, less the width of a slot separating adjacent ring sectors, about the circumference of the wall of the coil body and is conductively connected with at least one of the turn conductors of the coil body. This serves to provide the highest possible axial magnetic flux density up to diameters as close as possible to the outer diameter of the contact element. For an outer diameter of 100 mm, the short-circuit current may be at least 40 KA and the rated voltage at least 36 KV. Nevertheless, measurements of the magnetic field of the switch contacts have shown that during the burning of the switching arc in the circular ring sectors of the contact elements, only those current threads are possible which extend from the bases of the arcs essentially radially to the associated turn conductor section. Preferably, the ring sectors are provided with cut-in gaps from the inside out extending only to the region of the inner diameter of the turn conductors, or slightly beyond, which contribute considerably to this result. The axial magnetic field generated by the flow of current through the arc into the turn conductors is practically not influenced at all by the magnetic field generated in the circular ring sectors by such radial current threads. Since other current thread directions are suppressed in the contact elements, the magnetic field is not weakened by such current threads in the annular contact element even if the arc roots are not distributed uniformly over the contact surface. Rather, the axial magnetic field is reinforced at the locations of asymmetrical balling together of arc roots on the respective contact element so that an accordingly increased current component flows through the turn conductors which are associated with the circular ring sectors and on which takes place the balling together of the roots. Because of the additional cut-in gaps, only eddy currents of practically negligible magnitude appear in the circular ring sectors.

The slots provided to form the turn conductors in the wall of the coil body cup also subdivide the bottom of the coil body cup so that damaging eddy currents are also prevented there. Moreover, balling together of the arc roots in the region of the contact axis is prevented because the circular ring sectors end at a distance from the contact axis or, more precisely, the axis of the contact pins.

The arrangement of four slots in each switch contact at a considerable angle relative to the axis of the contact pins produces flat winding sections (turn conductors) which contribute a large percentage of the axial magnetic field. Compared to this amount, the magnetic fields resulting from eddy currents is negligible. The arrangement is such that the slots in the cup wall extend at most over a rotation angle of 90° in the circumferential direction and then they continue through the bottom of the cup at the same angle of inclination. In addition, a supporting ring of an electrically poorly conducting CrNi steel and having a thin wall thickness is arranged in the switch contacts between the contact element and the bottom of the cup in close proximity to the inner diameter of the cup wall. This supporting ring keeps the impact forces generated during the pressing together of the contact elements away from the coil turn sections. The proximity of the supporting ring to the turn conductors minimizes the effect of the bridging of the turn conductors.

In the region of the outer diameter of the cup body, the circular ring sectors may also be connected with one another, preferably by a web having a small cross section. This simplifies attachment to the coil body by soldering.

In order to fix the supporting ring in a simple manner, it is soldered radially to the inner cup wall of the coil body at the open cup side. For this purpose, the edge region of the supporting ring facing the ring sectors of the contact element is provided with a radially outwardly oriented soldering collar.

BRIEF DESCRIPTION OF THE DRAWINGS

The invention will now be described in greater detail with reference to the drawing figures for one embodiment thereof, wherein.

DETAILED DESCRIPTION OF THE PREFERRED EMBODIMENT

Figure 1:
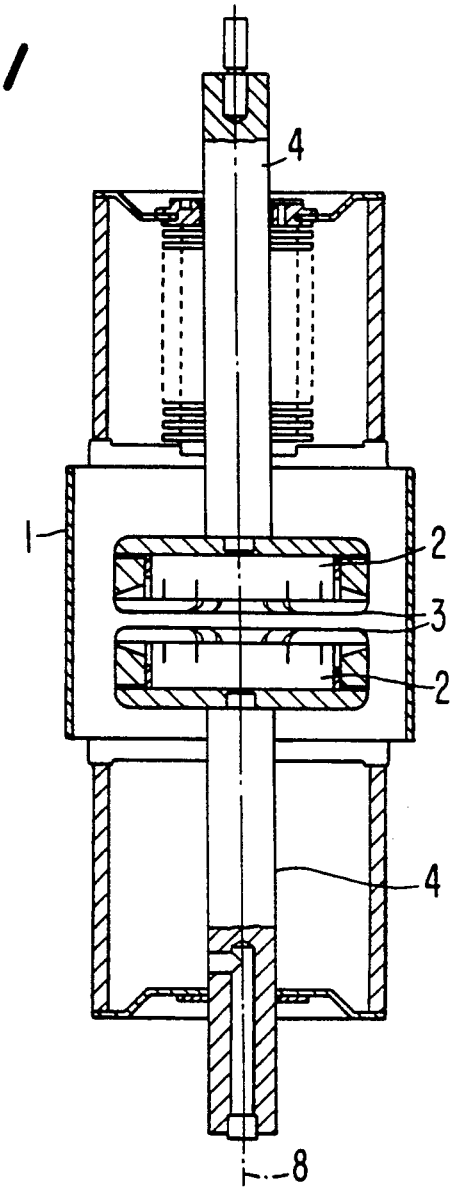
FIG. 1 is a longitudinal, cut-open view of a vacuum switching chamber provided with switch contacts in accordance with the invention.
Figure 2:
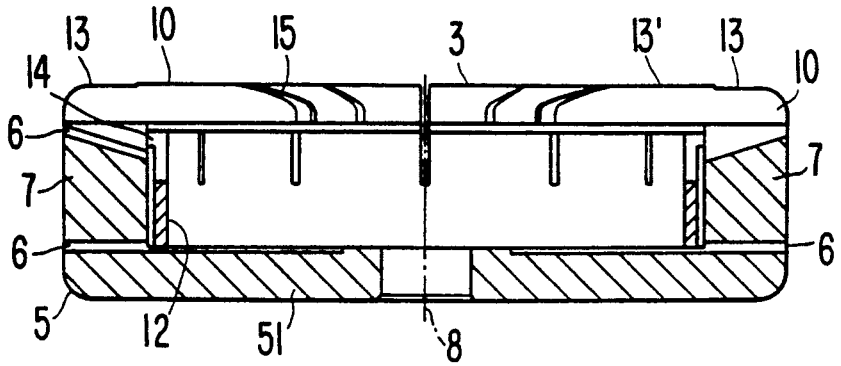
FIG. 2 is a partial, lateral sectional view of the lower switch contact shown in FIG. 1.
Figure 3:
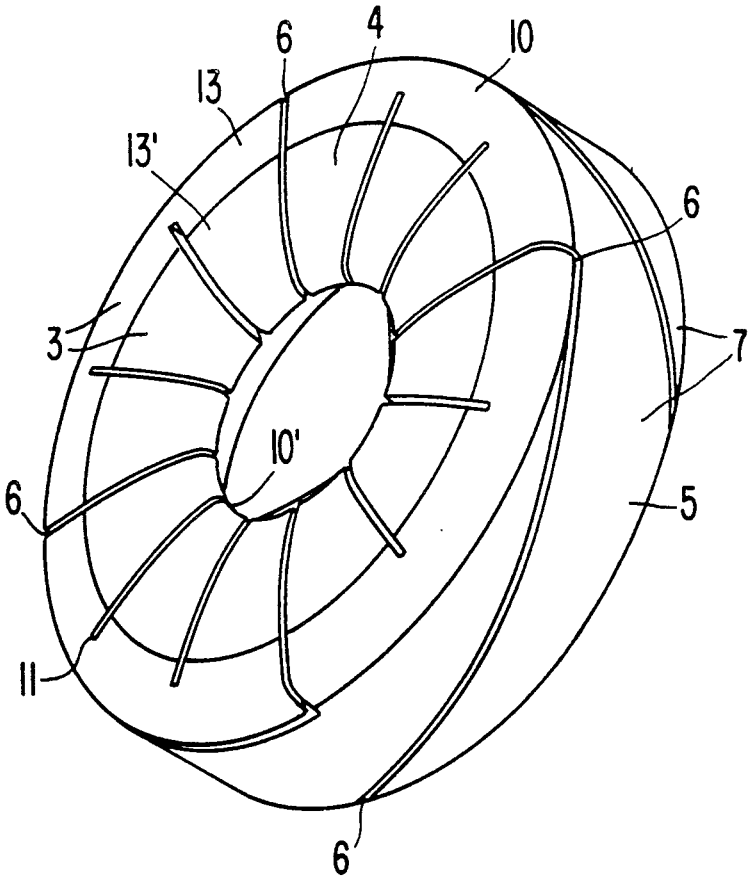
FIG. 3 is a perspective view of the switch contact shown in FIG. 2.
Figure 4:
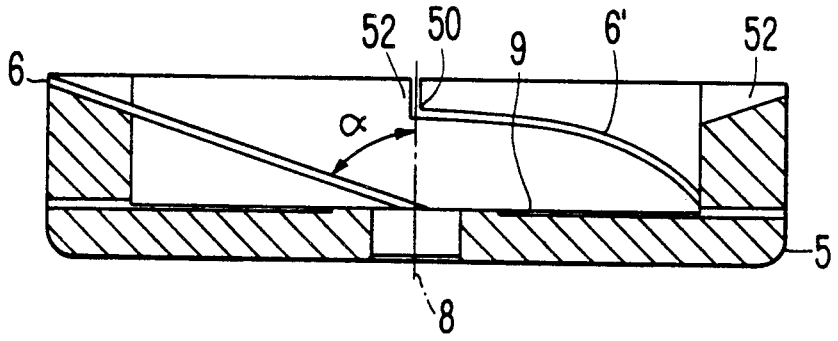
FIG. 4 is a lateral sectional view of the coil body of a switch contact according to the invention.
Figure 5:
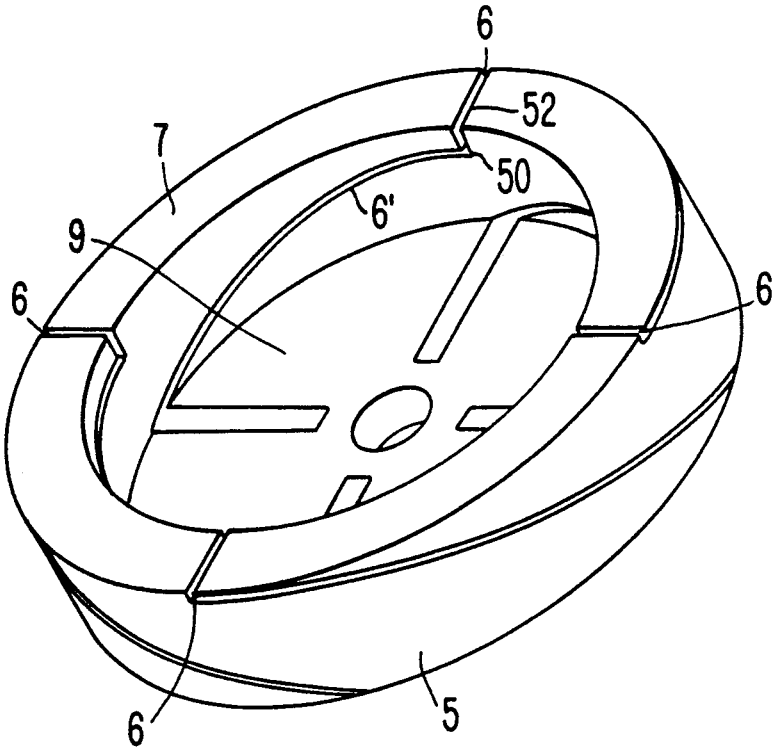
FIG. 5 is a perspective view of the coil body shown in FIG. 4.

Referring to FIG. 1, there is shown an evacuated housing 1 enclosing a vacuum switching chamber comprising two switch contacts 2 having end faces which face one another. Switch contacts 2 are covered with contact elements 3 on their mutually facing end faces. Switch contacts 2 are seated on mutually facing ends of coaxial contact pins 4, of which at least one is mounted to be axially movable. Each switch contact 2 is provided with a cup-shaped coil body 5, as shown in FIGS. 2 to 4, at whose open end face contact element 3 is attached. The cup wall of coil body 5 is subdivided by four slots 6 to form four turn conductors 7. Slots 6 have a central section 6' (FIGS. 4 and 5) between cup bottom face 9 and an edge 50 at which central section 6' of slot 6 changes into a slot section 52 whose plane includes contact axis 8. Central slot sections 6' are created by planar cuts through the cup wall, at an angle $\alpha$ 60° and 75° relative to axis 8 of contact pins 4 (see FIG. 4). Central section 6' of these cuts, covers an angle of rotation between 60° and 90° in the circumferential direction.

Contact elements 3 are each composed of four circular ring sectors 10 each of which is associated with a turn conductor 7 and extends over the circumferential section of the turn conductor on the open side of the coil body. The radial distance of the inner edges 10' of circular ring sectors 10 from axis 8 is at least 35 % of the outer radius of coil body 5. Each circular ring sector 10 has at least one, in the present case two, cut-in gaps 11 which extend radially from the inside to the outside up to the inner diameter, preferably even slightly into the region of the respective turn conductor 7, as shown in FIG. 3.

Slots 6 extend through cup bottom 51 and are cut in deeper radially than the radial wall thickness of turn conductors 7. This radial cutting depth for slots 6 in cup bottom 51 measured from the outer diameter of coil body 5 is about 40% of the diameter of coil body 5. The formation of annoying eddy currents is thus counteracted. In the region of circular ring sectors 10, slots 6 extend between adjacent circular ring sectors 10 in a plane defined by the axis 8 of contact pins 4.

In the cavity between circular ring segments 10 and cup bottom 51, there is disposed a supporting ring 12 which is arranged to be concentric with axis 8 and is seated on cup bottom 51 while supporting the circular ring sectors 10 in the vicinity of the open cup side. Circular ring sectors 10 are set back in height at the outer circumference of coil body 5 in the manner of a step 13 toward the coil body, and have surface portions 15 which are sloped radially inwardly beginning with a planar central section 13' to form a toroidal configuration. This toroidal configuration of the surface portions 15 facing axis 8 serves to uniformly distribute the roots of a current arc on the contact face. The radially outwardly oriented step 13 constitutes a limitation of the region where the operating current is transferred through the contacts and thus a limitation of the region of the contact element on which, immediately after galvanic separation of the contacts, the first switching arc roots develop, to a diameter region having a high axial magnetic flux density. Supporting body 12 is thus disposed underneath planar section 13' of circular ring sectors 10 on which impinge the forces acting when contacts 2 are closed. These forces are transferred directly to cup bottom 51 and are unable to lead to narrowing of slots 6 or to mechanical oscillations in the coil body. Moreover, supporting ring 12, due to its close proximity to the well conducting turn conductors 7, does not constitute a significant shunt path for transverse or eddy currents. A soldering collar 14 is provided to simplify the fastening of supporting ring 12. Soldering collar 14 is shaped onto the exterior of supporting ring 12 so as to extend radially outwardly on its edge region facing the coil body. Supporting ring 12 is here fixed by soldering in the same manner as at cup bottom 51. Slots 6 in contact elements 3 of both switch contacts 2 may be arranged to be mutually congruent in the vacuum switch chamber. They may also assume another rotation angle position about axis 8; preferably the rotation angle position is rotated by 45° relative to one another.

Figure 6:
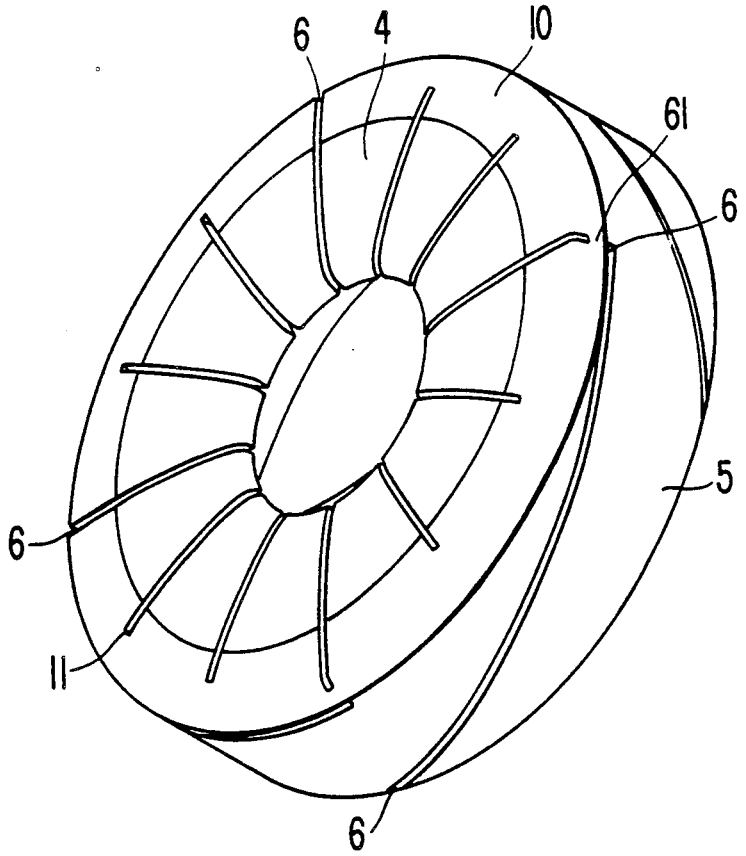
FIG. 6 is another embodiment of the switch contact.

Circular ring sectors 10 are composed of a sintered metal containing up to 75 percent copper and 25 percent chromium as disclosed in German Patent No. 3,406,535. With a maximum contact spacing of 20 mm and an outer diameter of 98 mm for the switch contacts, and for a short-circuit current having an alternating short-circuit current value of 40 KA at a rated voltage of 36 KV, and for an alternating short-circuit current value of 50 KA at a rated voltage of 24 KV and 50 Hz, a vacuum switch according to the invention meets the requirements with respect to its switching behavior as specified in the applicable regulations, with arcbacks being reliably prevented. The radial width of turn conductors 7 is approximately one tenth of the diameter of coil body 5, while the wall thickness of supporting ring 12 is approximately one fourth of that of a turn conductor 7. Adjacent circular ring sectors 10 may be connected together in the region of their outer diameters by webs 61 having smaller cross-sectional dimensions than the circular ring sectors, as shown in FIG. 6.

Obviously, numerous and additional modifications and variations of the present invention are possible in light of the above teachings. It is therefore to be understood that within the scope of the appended claims, the invention may be practiced otherwise than as specifically claimed.

What is claimed is:

1. In a vacuum switch including two identical facing switch contacts which are disposed on mutually facing ends of coaxial contact pins, each switch contact including a cup-shaped coil body having a cup bottom, a cup wall, and an open end face, and an annular contact element covering the open end face of the cup-shaped coil body, the cup wall being penetrated by a plurality of continuous slots which are distributed uniformly over the circumference of the cup wall to form turn conductors, the slots being cut through the cup bottom and being inclined relative to the axis of the contact pins, the switch further including a concentric supporting ring disposed in the cavity between the cup bottom and the contact element, with the contact element being composed of circular ring sectors each of which extends in the circumferential direction over a section of at least one turn conductor between two slots, the improvement wherein:

said plurality of slots comprises four slots, each said slot having a central section formed by a planar cut through said cup wall, with said cuts being inclined at an angle between 60° and 75° relative to the axis of the contact pins, and the central section of said slots covering an angle of rotation between 60° and 90° in the circumferential direction of said cup wall; and each said circular ring sector includes at least one cut-in gap which is directed radially from the inside of said circular ring sector toward the outside of said ring sector extending to the region of the inner diameter of said cup wall, each said turn conductor of said cup wall having a radial wall thickness which is approximately 10% of the outer diameter of said coil body.

2. A vacuum switch as defined in claim 1, wherein adjacent circular ring sectors of said contact element are separated by a slot which forms an extension of a respective one of the slots in said cup wall and which lies in a plane defined by the axis of the contact pins.

3. A vacuum switch as defined in claim 2, wherein said cup wall has an end face adjacent the circular ring sectors and the respective slots between adjacent circular ring sectors, each of which is in a plane of the axis of the contact pins, extend into the end face of the cup wall.

4. A vacuum switch as defined in claim 1, wherein said supporting ring has an edge region facing said circular ring sectors, and further including a soldering ring disposed at the edge region of said supporting ring, said soldering collar being oriented radially outwardly toward said cup wall and having a relatively small radial and axial dimension and being soldered to said turn conductors.

5. A vacuum switch as defined in claim 1, further comprising webs connecting together adjacent circular ring sectors in a region of the outer diameter of said circular ring sectors, wherein said webs have smaller cross-sectional dimensions than said circular ring sectors.

6. A vacuum switch as defined in claim 1, wherein the slots are radially cut into said cup bottom to extend radially inwardly to approximately 40% of the diameter of said coil body.

7. A vacuum switch as defined in claim 1, wherein each circular ring sector includes two cut-in gaps which extend radially from the inside toward the outside of each said ring sector.

8. A vacuum switch as defined in claim 1, wherein said circular ring sectors comprise sintered metal which includes approximately 75 percent copper and approximately 25 percent chromium.

9. A vacuum switch as defined in claim 1, wherein, wherein said circular ring sectors have an outer circumferential region which is set back in height in the axial direction to form a radial step and have a radially interior region which is toroidally sloped.

* * * * *